US007986275B2

(12) United States Patent
Huang et al.

(10) Patent No.: US 7,986,275 B2
(45) Date of Patent: Jul. 26, 2011

(54) DUAL-BAND ANTENNA

(75) Inventors: Chih-Yung Huang, Taichung County (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 379 days.

(21) Appl. No.: 12/413,871

(22) Filed: Mar. 30, 2009

(65) Prior Publication Data

US 2010/0045564 A1 Feb. 25, 2010

(30) Foreign Application Priority Data

Aug. 22, 2008 (TW) ..... 97132124 A
Oct. 28, 2008 (TW) ..... 97141319 A

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS 7,586,448 B2 * 9/2009 Wei ..... 343/702
2008/0191957 A1 * 8/2008 Chang ..... 343/845

* cited by examiner

*Primary Examiner* — Hoang V Nguyen
(74) *Attorney, Agent, or Firm* — Tim Tingkang Xia; Morris, Manning & Martin, LLP

(57) ABSTRACT

The present invention discloses a dual-band antenna integrated with GSM wireless communication apparatuses, comprising: a first radiation unit; a first connecting portion; a second radiation unit; a second connecting portion; a grounding unit; a grounding extension unit; a signal feed-in terminal; and a signal grounding terminal. Therefore, the dual-band antenna integrated with GSM wireless communication apparatuses of the present invention has a broad effective operating band to significantly enhance the transceiving performance.

12 Claims, 12 Drawing Sheets

DUAL-BAND ANTENNA

BACKGROUND OF THE INVENTION

1. Field of the Invention

The present invention generally relates to a dual-band antenna integrated with GSM wireless communication apparatuses and, more particularly, to a dual-band antenna with a broad effective operating band.

2. Description of the Prior Art

In highly developed modern days, to meet the requirement for communications, there have been reported compact antennas with various sizes so as to be used in more-and-more compact hand-held electronic devices such as mobile phones or notebook computers or wireless communication devices such as access points (APs). For example, the planar inverse-F antenna (PIFA) that is compact, high-performance and easily disposed on the inner wall of a hand-held electronic device has been widely used in various wireless transmission devices in hand-held electronic devices, notebook computers or wireless communication devices. However, the currently available dual-band antenna integrated with GSM wireless communication apparatus suffers from effective operating bandwidth insufficiency due to its poorly designed structure that limits its transceiving performance.

Therefore, there exists a need in providing a dual-band antenna integrated with GSM wireless communication apparatuses that has a broad effective operating band to significantly enhance the transceiving performance.

SUMMARY OF THE INVENTION

It is one object of the present invention to provide a dual-band antenna integrated with GSM wireless communication apparatuses to overcome effective operating bandwidth insufficiency of the conventional dual-band antenna.

In order to achieve the foregoing object, the present invention provides a dual-band antenna, which is integrated with GSM wireless communication apparatuses, comprising: a first radiation unit, being a U-shaped three-dimensional structure, having a first extension portion at one terminal and a second extension portion on one side; a first connecting portion, being disposed on the other side of the first radiation unit; a second radiation unit, being a banded structure, connecting the first radiation unit with one side of the second radiation unit by the first connecting portion and a first gap formed between the first radiation unit and the second radiation unit, one terminal of the second radiation unit extending as a third extension portion, and the other side of the second radiation unit and one side of the third extension portion forming a fourth extension portion; a second connecting portion, being disposed at the other terminal of the first radiation unit; a grounding unit, being a banded structure, connected to the first radiation unit by the second connecting portion, wherein a second gap is formed between the grounding unit and the second radiation unit and a third gap is formed between the grounding unit, the second connecting portion and the first radiation unit; a grounding extension unit, being disposed on one side of the grounding unit, wherein a fourth gap is formed between the grounding extension unit and the second radiation unit; a signal feed-in terminal, being disposed on the second radiation unit; and a signal grounding terminal, being disposed on the grounding unit.

Preferably, the first radiation unit, the first connecting portion, the second radiation unit, the second connecting portion, the grounding unit, the grounding extension unit, the signal feed-in terminal and the signal grounding terminal are formed as one metal structure.

Preferably, the dual-band antenna integrated with GSM wireless communication apparatuses further comprises a support portion connected to the dual-band antenna to stabilize the dual-band antenna.

Preferably, the dual-band antenna integrated with GSM wireless communication apparatuses further comprises a second grounding unit being disposed on the grounding unit so that the grounding unit is connected to a grounding device of the GSM wireless communication apparatus through the second grounding unit.

Preferably, the operating frequency of the first radiation unit is lower than the operating frequency of the second radiation unit.

Preferably, the first radiation unit and the second radiation unit are disposed in parallel or approximately in parallel.

Preferably, the second radiation unit and the grounding unit are disposed in parallel or approximately in parallel.

Preferably, a fifth gap is formed between the grounding extension unit and the fourth extension portion.

Preferably, a sixth gap is formed between the second gap and the fourth gap.

Preferably, a seventh gap is formed between the second gap and the third gap.

Therefore, the dual-band antenna integrated with GSM wireless communication apparatuses of the present invention has a broad effective operating band to significantly enhance the transceiving performance.

BRIEF DESCRIPTION OF THE DRAWINGS

The objects, spirits and advantages of the preferred embodiment of the present invention will be readily understood by the accompanying drawings and detailed descriptions, wherein.

DETAILED DESCRIPTION OF THE PREFERRED EMBODIMENT

Figure 1A:
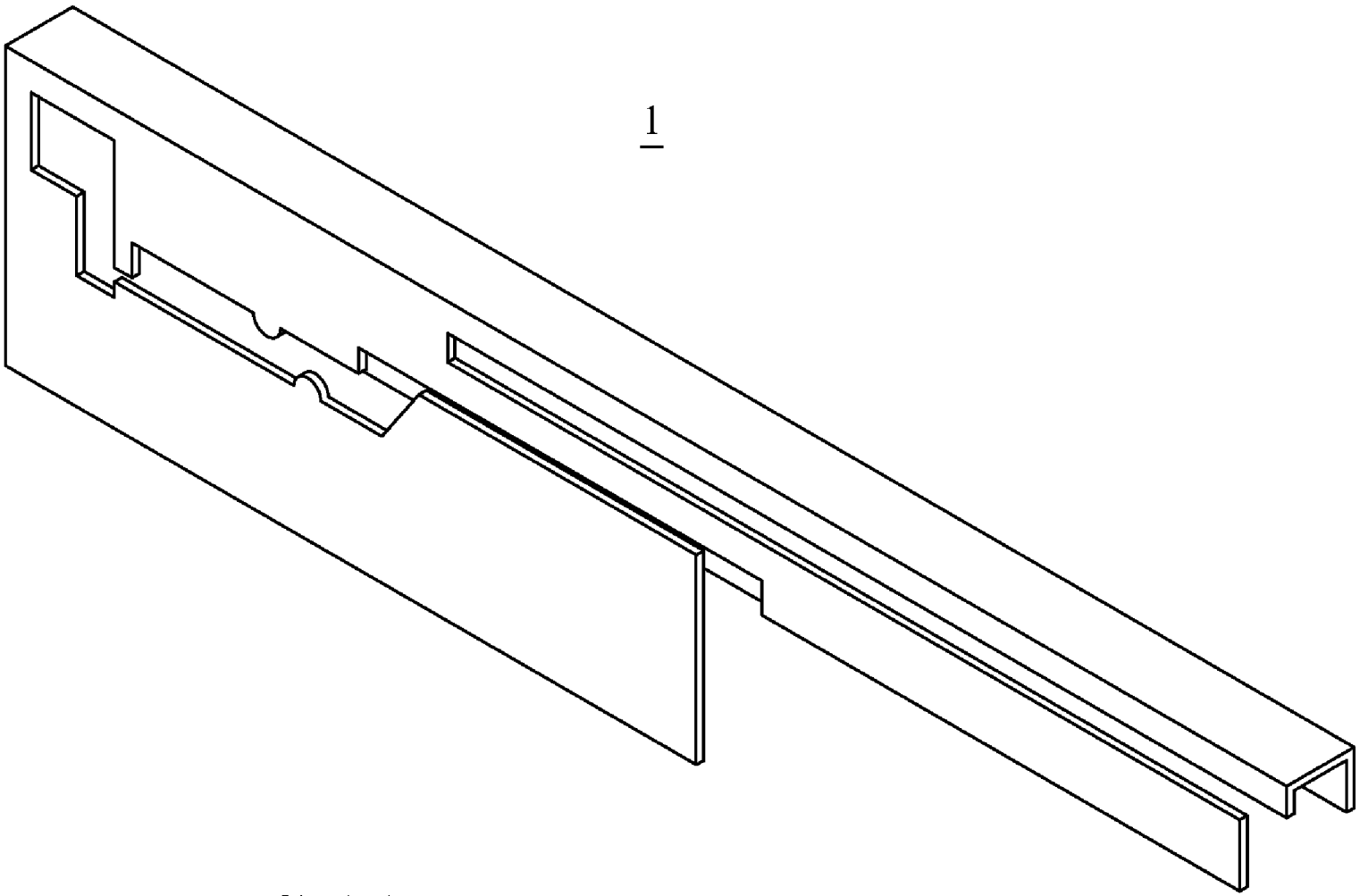
FIG. 1 to FIG. 1D are three-dimensional diagrams of the dual-band antenna according to the preferred embodiment of the present invention.
Figure 1B:
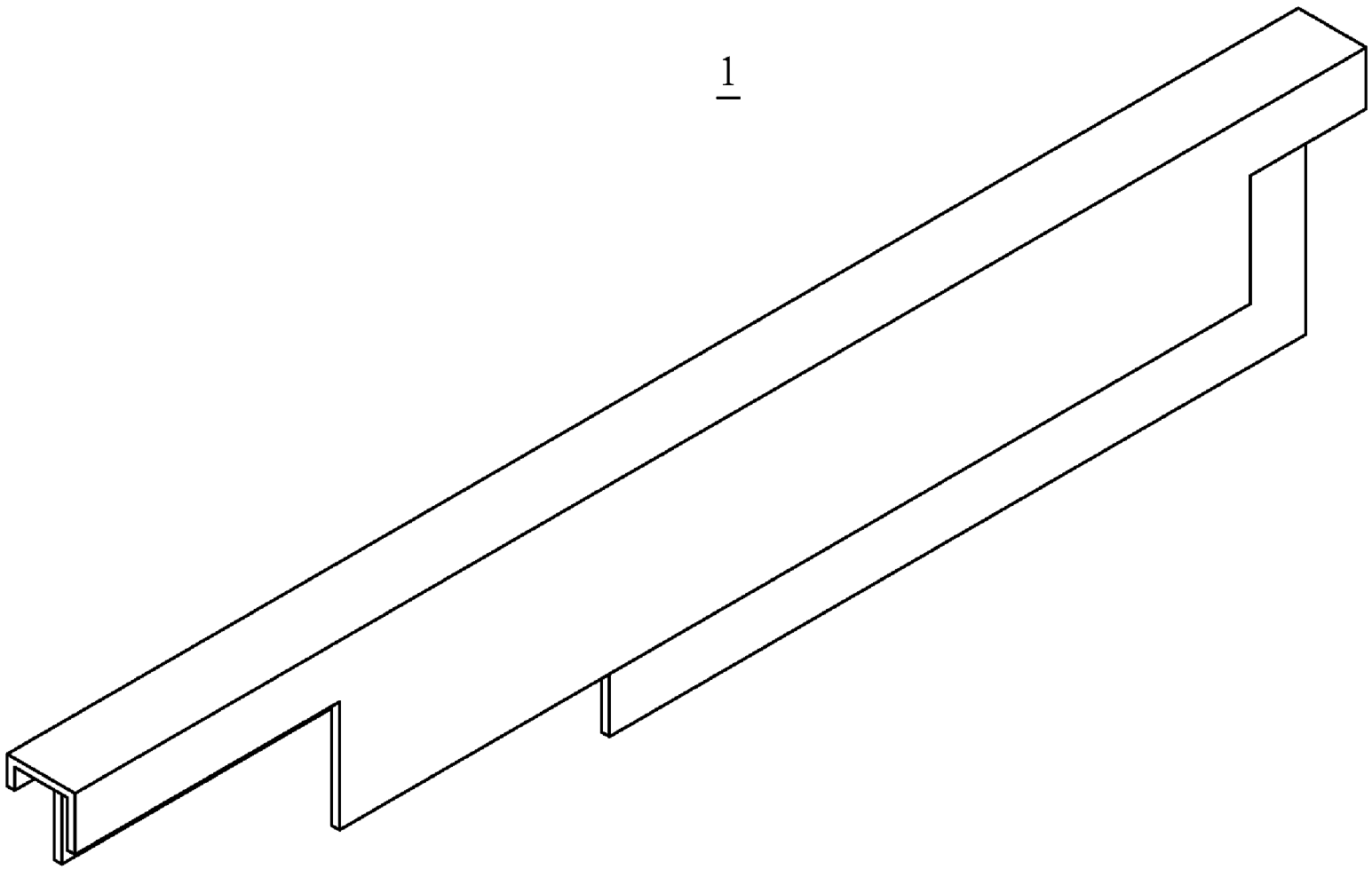
Figure 1C:
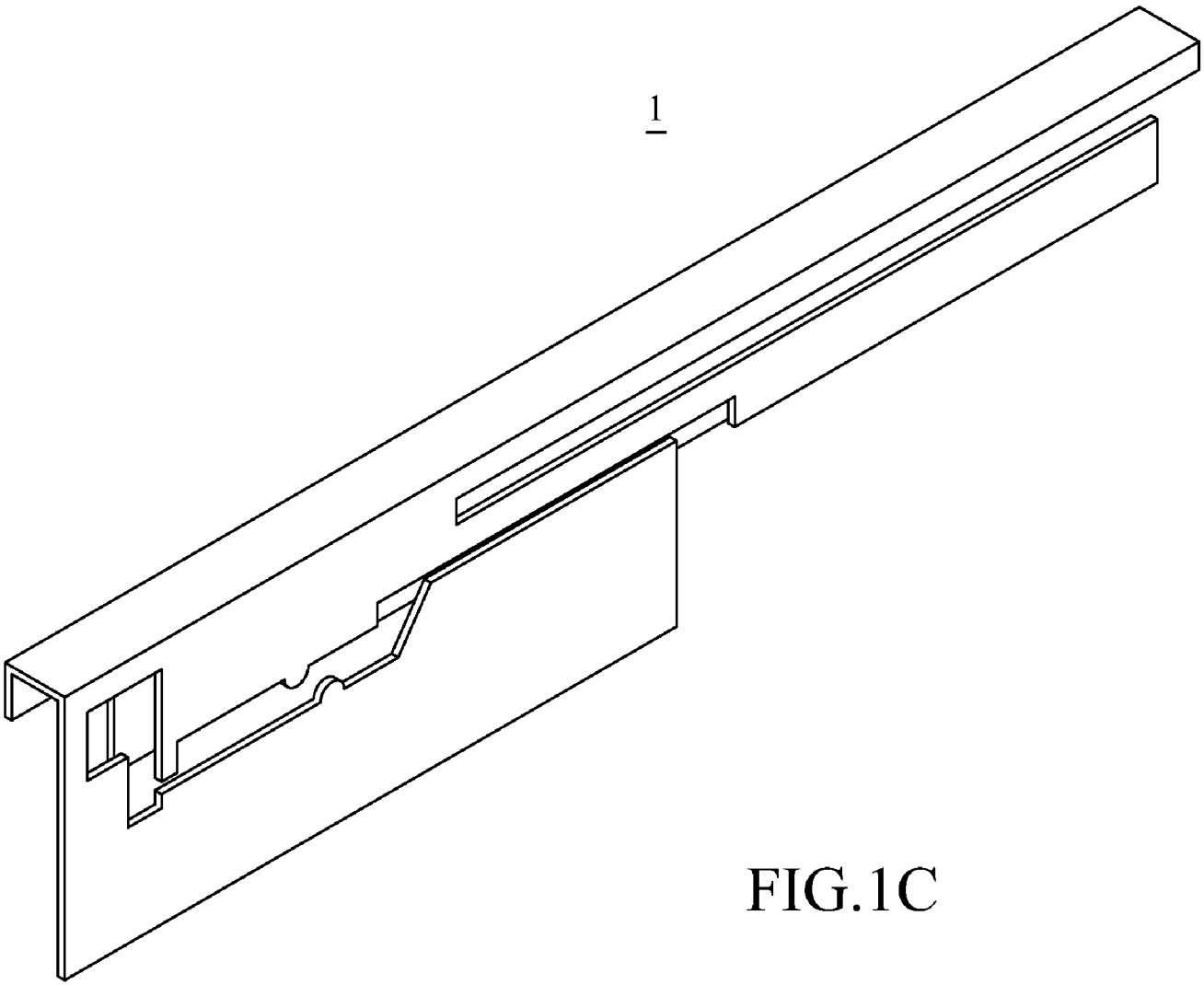
Figure 1D:
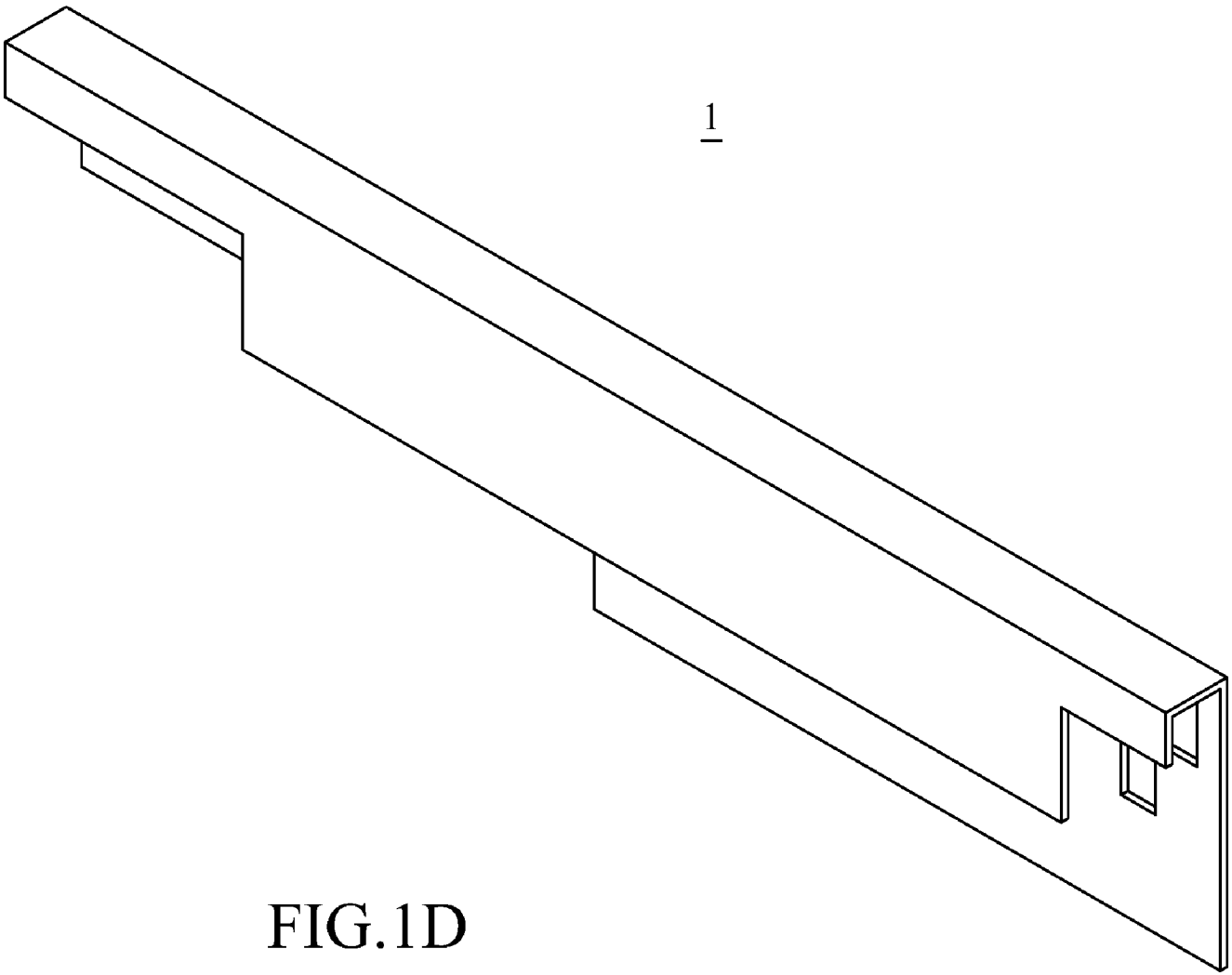
Figure 2A:
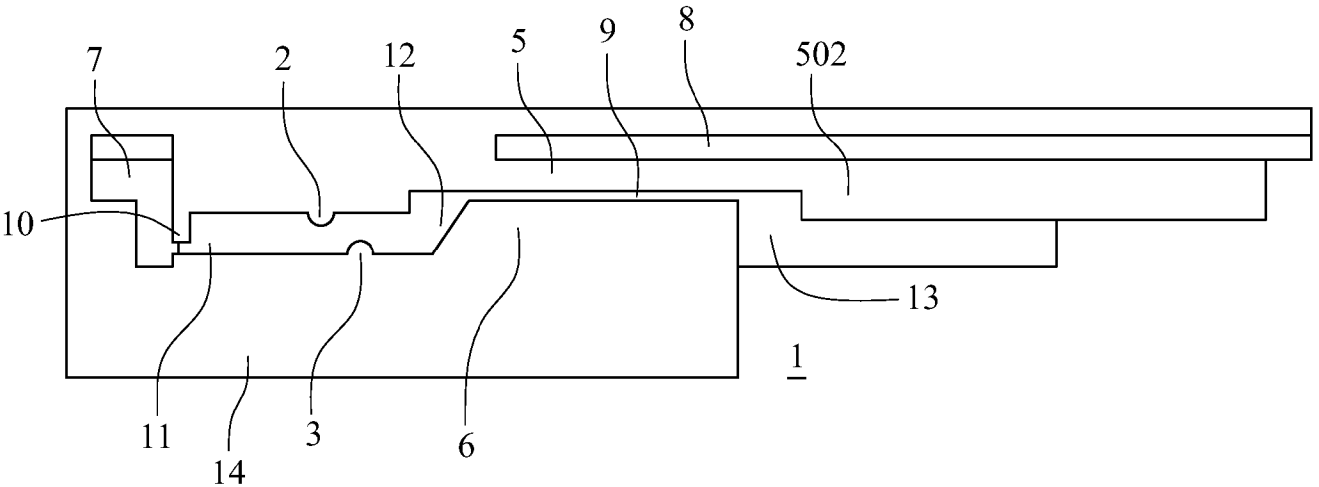
FIG. 2A to FIG. 2K are front and rear views of the dual-band antenna according to the preferred embodiment of the present invention.
Figure 2B:
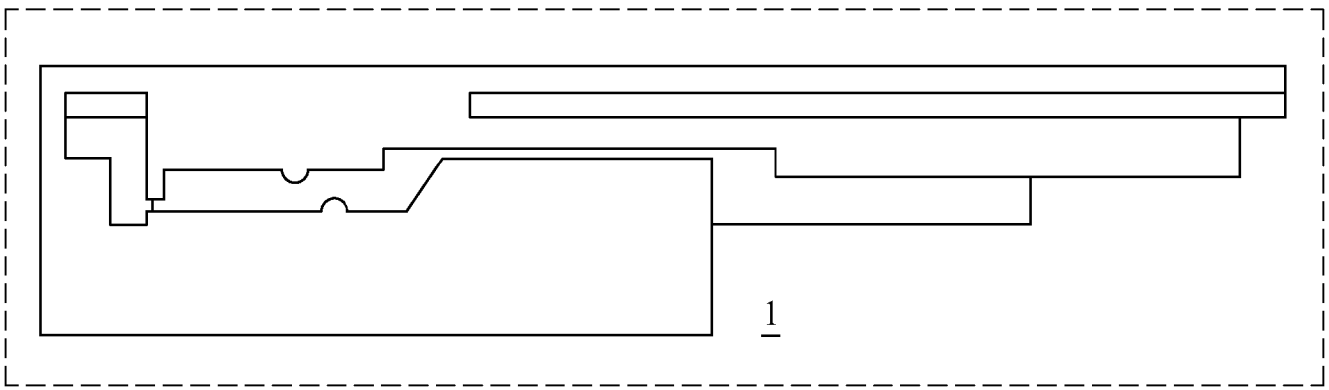
Figure 2C:
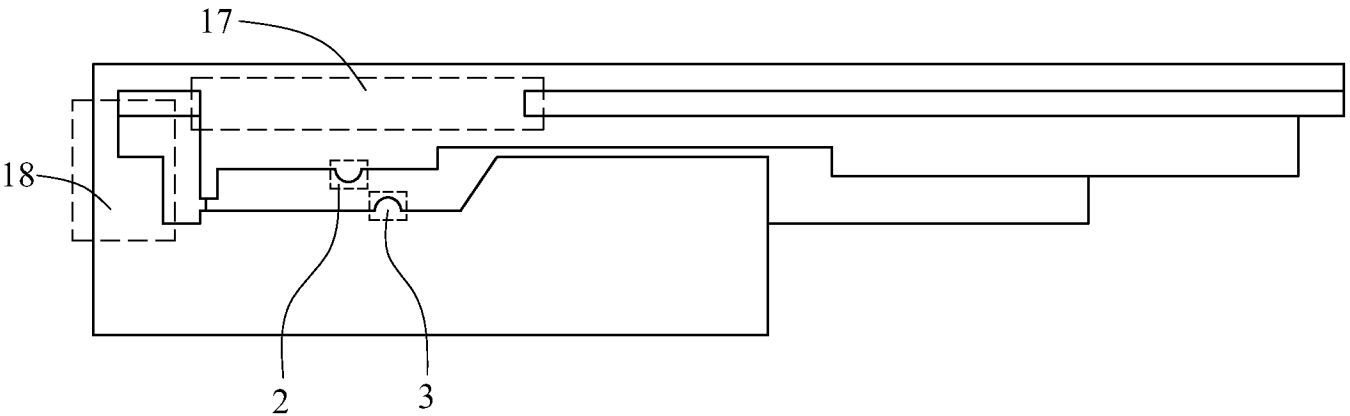
Figure 2D:
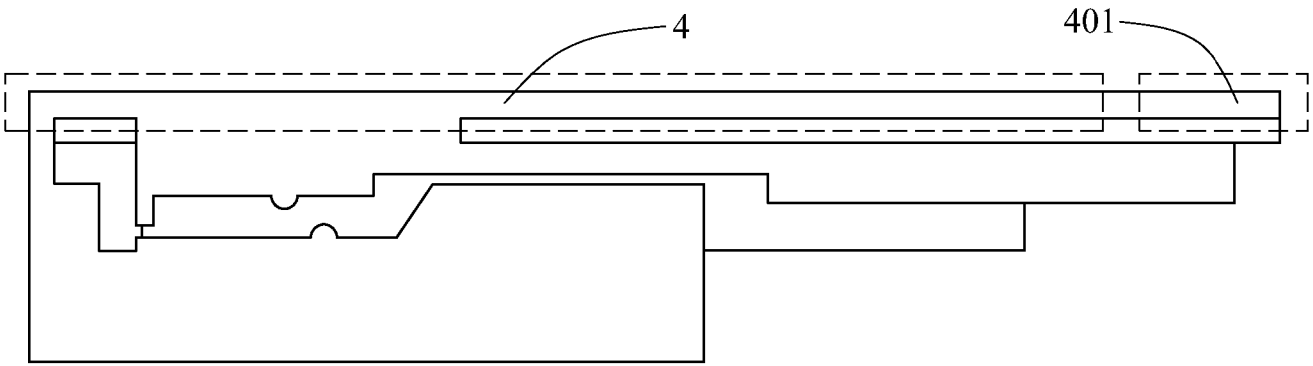
Figure 2E:
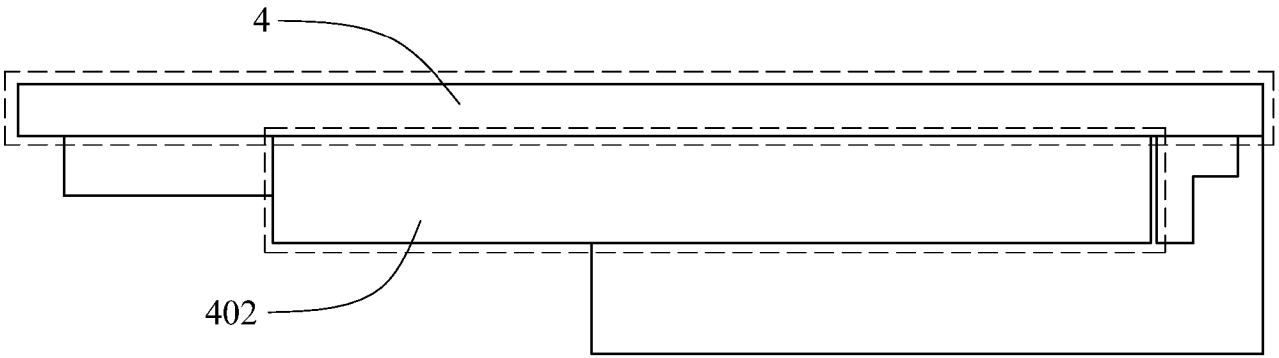
Figure 2F:
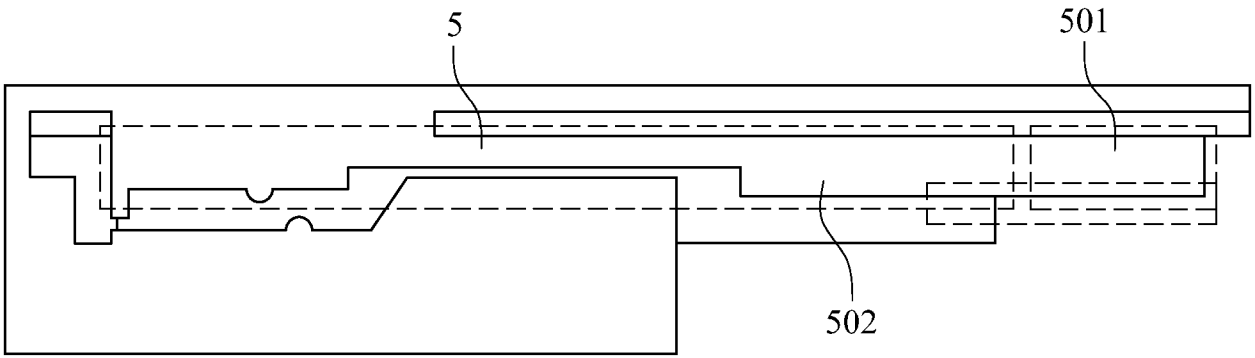
Figure 2G:
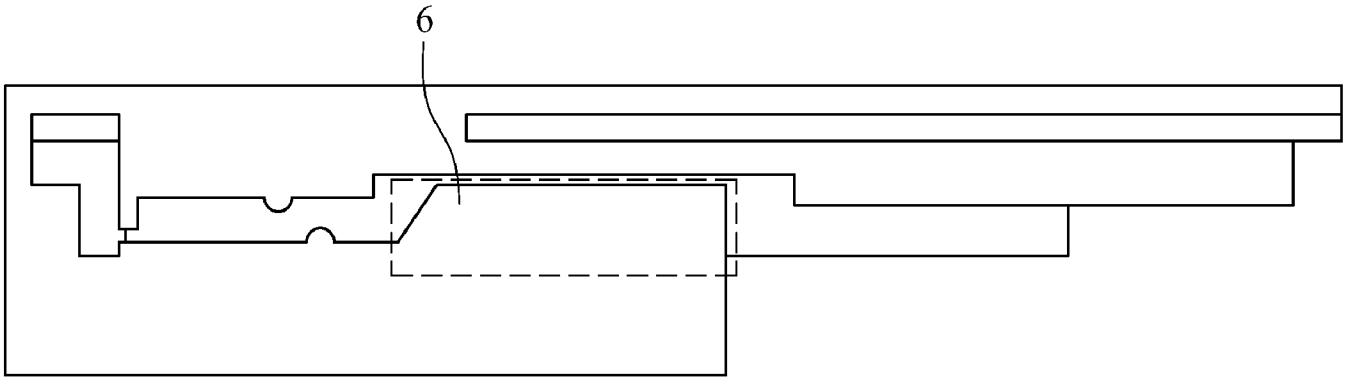
Figure 2H:
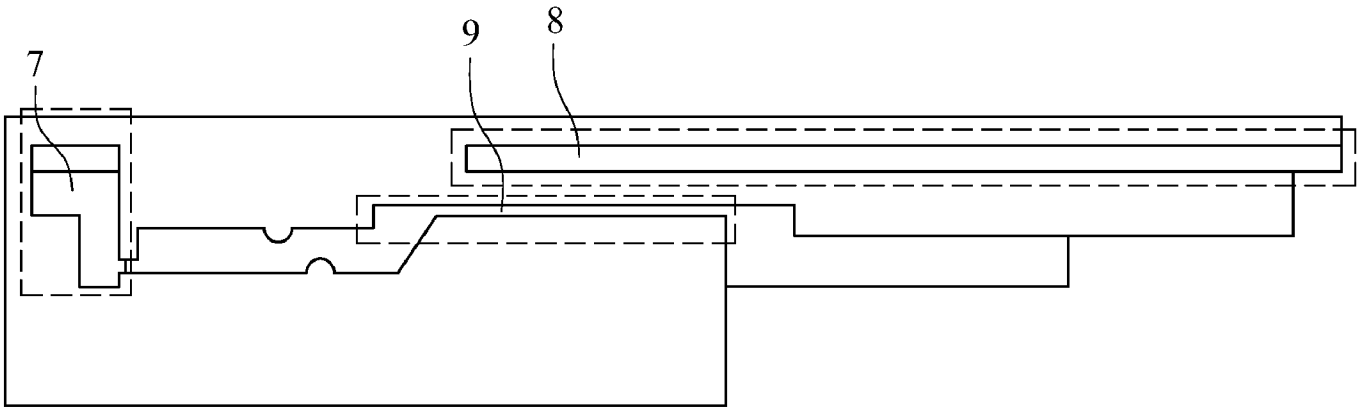
Figure 2I:
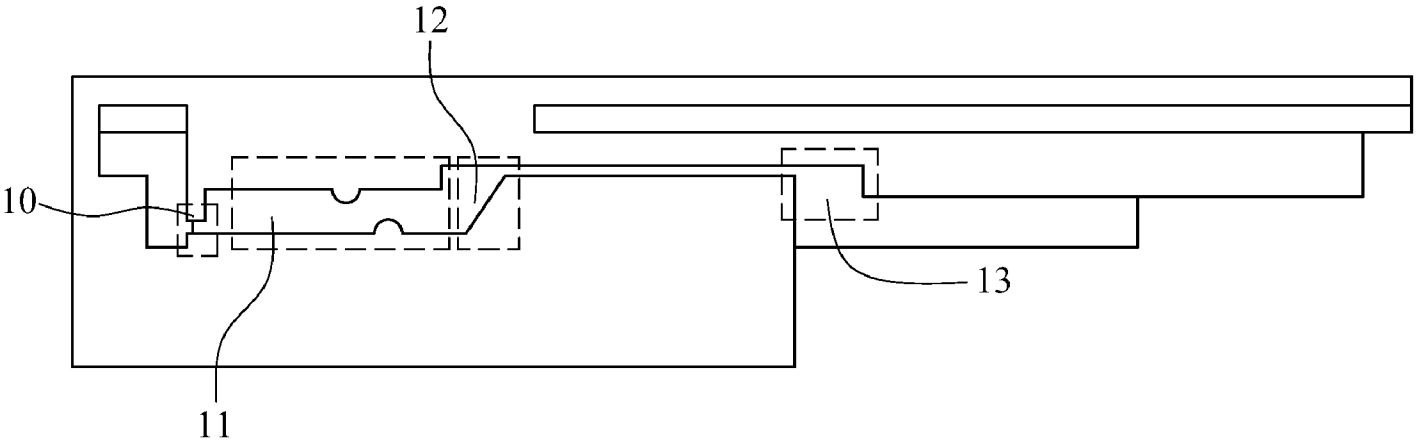
Figure 2J:
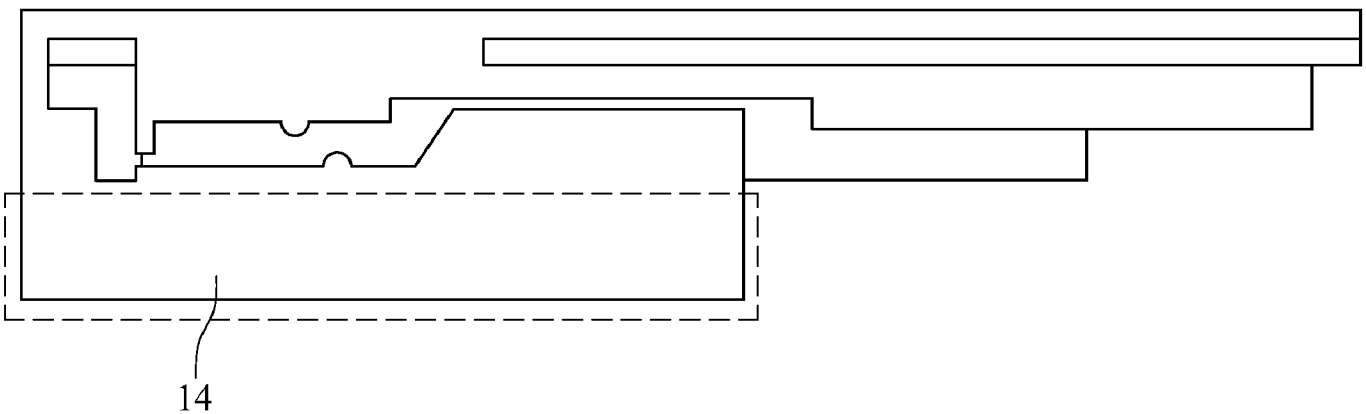
Figure 2K:
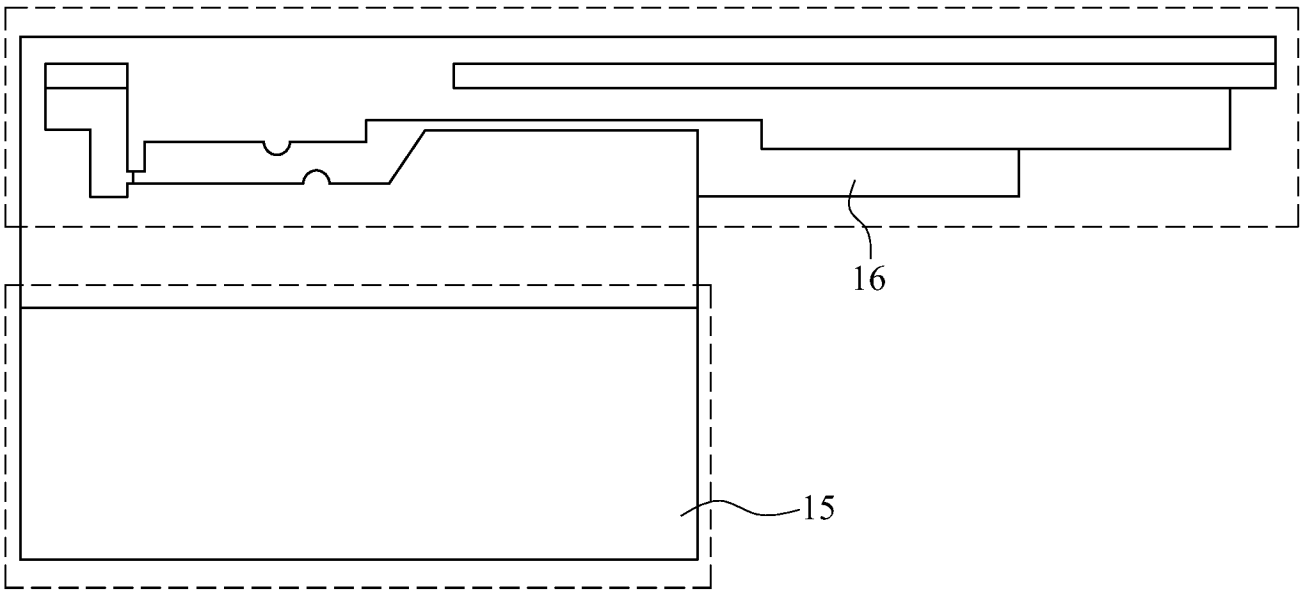

The present invention can be exemplified by the preferred embodiment as described hereinafter.

FIG. 1A to FIG. 1D are three-dimensional diagrams of the dual-band antenna according to the preferred embodiment of the present invention, and FIG. 2A to FIG. 2K are front and rear views of the dual-band antenna according to the preferred embodiment of the present invention. Please refer to FIG. 1A to FIG. 1D and FIG. 2A to FIG. 2K, the dual-band antenna 1 integrated with GSM wireless communication apparatuses of the present invention comprises: a first radiation unit 4, a first connecting portion 17, a second radiation unit 5, a second connecting portion 18, a grounding unit 14, a grounding extension unit 6, a signal feed-in terminal 2, and a signal grounding terminal 3.

The first radiation unit 4, being a U-shaped three-dimensional structure, has a first extension portion 401 at one terminal and a second extension portion 402 on one side, wherein the length and the width of the first extension portion 401 and the shape and the size of the second extension portion 402 are adjusted to control the operating band and bandwidth of the first radiation unit 4. The shape of the second extension portion 402 is a rectangle, a trapezoid, a triangle or other polygon. The first connecting portion 17 is disposed on the other side of the U-shaped structure of the first radiation unit 4. The second radiation unit 5 is a banded structure, wherein a first gap 8 is formed between two adjacent sides of the first radiation unit 4 and the second radiation unit 5 by connecting the first connecting portion 17 and the first radiation unit 4 on one side of the second radiation unit 5 so that the first radiation unit 4 and the second radiation unit 5 are disposed in parallel or approximately in parallel. One terminal of the second radiation unit 5 extends as a third extension portion 501. The operating frequency (for example, 0.9 GHz to 1.1 GHz) of the first radiation unit 4 is lower than the operating frequency (for example, 1.3 GHz to 2.1 GHz) of the second radiation unit 5. One side of the second radiation unit 5 and the third extension portion 501 forms a fourth extension portion 502. The length and the width of the third extension portion 501 and the shape and the size of the fourth extension portion 502 are adjusted to control the operating band and bandwidth of the second radiation unit 5. The shape of the fourth extension portion 502 is a rectangle, a trapezoid, a triangle or other polygon. The second connecting portion 18 is disposed at the other terminal of the first radiation unit 4. The grounding unit 14 is a banded structure, wherein a second gap 11 is formed between the grounding unit 14 and the second radiation unit 5 and a third gap 7 is formed between the grounding unit 14, the second connecting portion 18 and the first radiation unit 4 by connecting the second connecting portion 18 and the first radiation unit 4 so that the second radiation unit 5 and the grounding unit 14 are disposed in parallel or approximately in parallel. The grounding extension unit 6 is disposed on one side of the grounding unit 14, wherein a fourth gap 9 is formed between the grounding extension unit 6 and the second radiation unit 5. The shape and the size of the first, the second, the third and the fourth gaps 8, 11, 7, 9 are adjusted to achieve impedance matching of the dual-band antenna 1 so that the dual-band antenna 1 exhibits excellent voltage-standing-wave ratio (VSWR). Moreover, a fifth gap 13 is formed between the grounding extension unit 6 and the fourth extension portion 502. Moreover, a sixth gap 12 is formed between the second gap 11 and the fourth gap 9. Moreover, a seventh gap 10 is formed between the second gap 11 and the third gap 7. The shape and the size of the fifth, the sixth, and the seventh gaps 13, 12, 10 are adjusted to achieve impedance matching of the dual-band antenna 1 so that the dual-band antenna 1 exhibits excellent voltage-standing-wave ratio (VSWR). The signal feed-in terminal 2 is disposed on the second radiation unit 5. The signal grounding terminal 3 is disposed on the grounding unit 14.

Generally, in order to better the transceiving performance and reduce the manufacturing cost of the antenna, it is preferable that the first radiation unit 4, the first connecting portion 17, the second radiation unit 5, the second connecting portion 18, the grounding unit 14, and the grounding extension unit 6 are formed as one metal structure. Preferably, the metal structure further comprises the signal feed-in terminal 2 and the signal grounding terminal 3. Preferably, the metal structure further comprises the first extension portion 401, the second extension portion 402, the third extension portion 501 and the fourth extension portion 502.

As stated above, since the structure of the present invention is a 3-D structure, it is preferable that the dual-antenna 1 further comprises a support portion 16 (such as styrofoam, but not limited thereto) connected to the 3-D structure or disposed inside the 3-D structure to stabilize the dual-band antenna 1. In the grounding device, it is preferably in the present invention uses a second grounding unit 15 (such as aluminum coil, but not limited thereto) disposed on the grounding unit 14 so that the grounding unit 14 is connected to the grounding device of the integrated GSM wireless communication apparatuses through the second grounding unit 15. The shape and the size of the grounding extension unit 6 and the second grounding unit 15 can be adjusted to reduce the return loss of the antenna and enhance the gain of the antenna.

Figure 3:
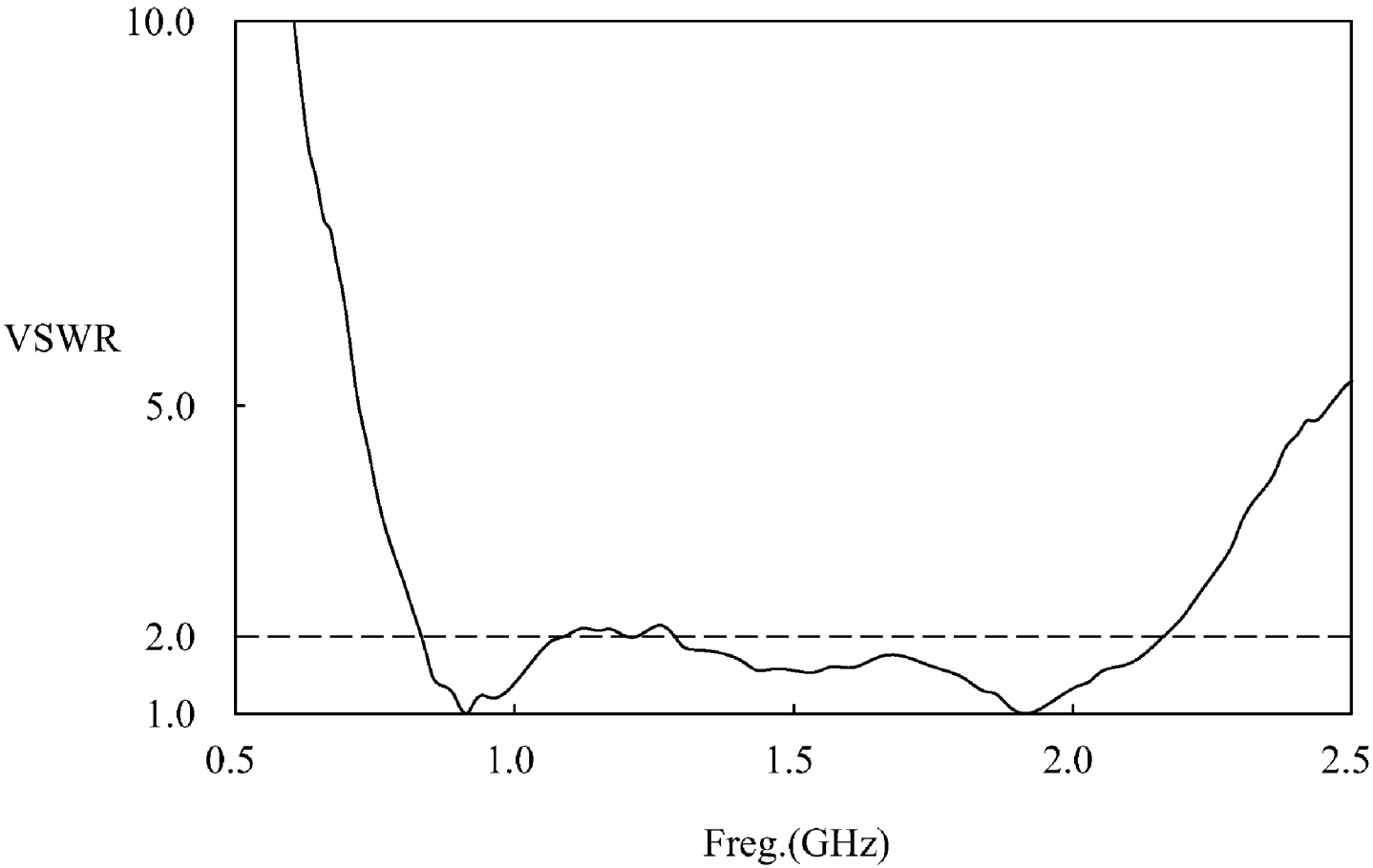
FIG. 3 shows the relation of measured voltage-standing-wave ratio (VSWR) to frequency according to the preferred embodiment of the present invention.

FIG. 3 shows the relation of measured voltage-standing-wave ratio (VSWR) to frequency according to the preferred embodiment of the present invention. Referring to FIG. 3, when a VSWR of 2 is used as a basis, the measured result shows that the dual-band antenna of the present invention exhibits a broad operating bandwidth.

Figure 4:
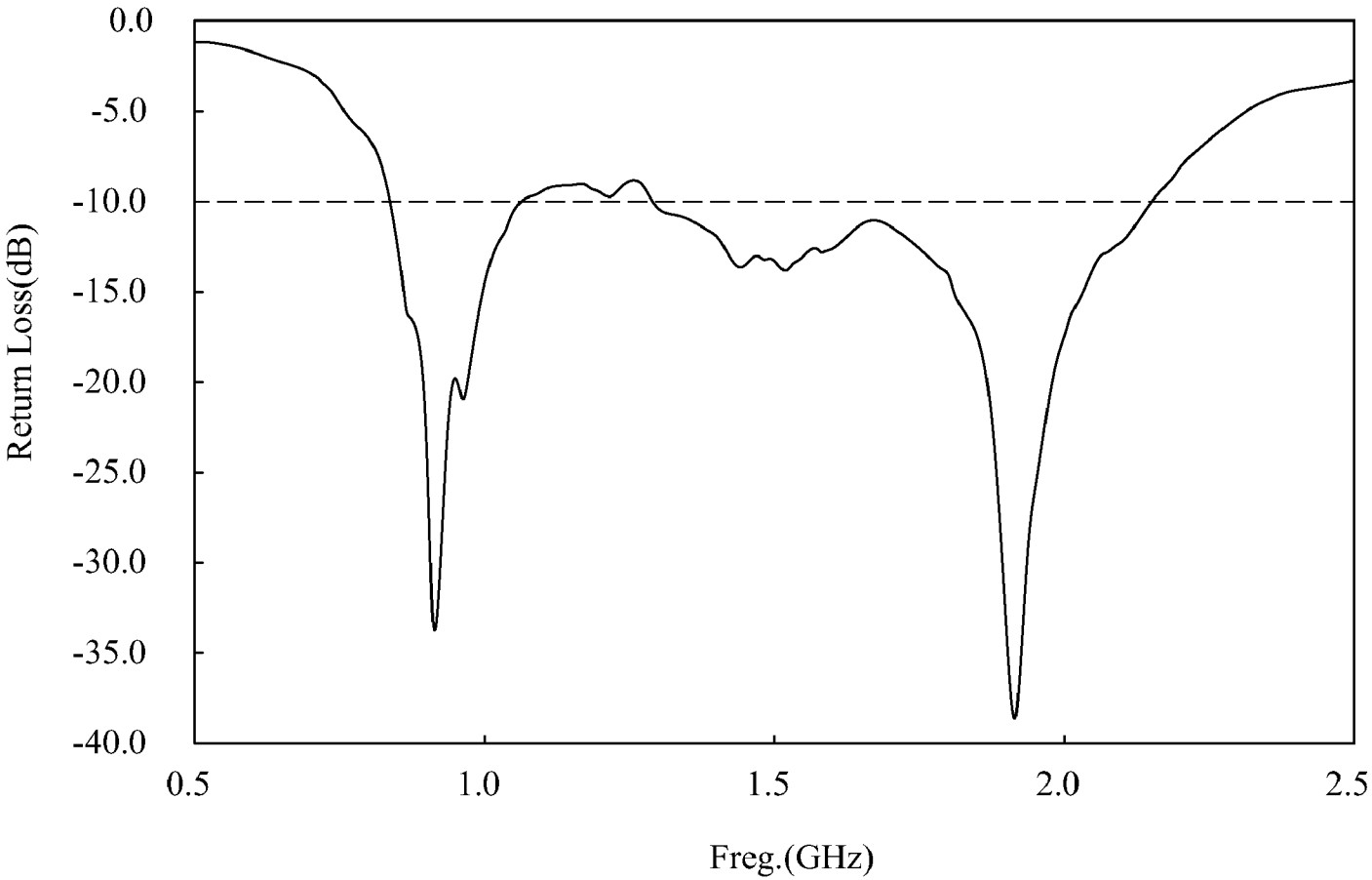
FIG. 4 shows the relation of measured return loss to frequency according to the preferred embodiment of the present invention.

FIG. 4 shows the relation of measured return loss to frequency according to the preferred embodiment of the present invention. Referring to FIG. 4, when a −10 dB is used as a basis, the measured result shows that the dual-band antenna of the present invention exhibits a broad operating bandwidth.

Accordingly, the present invention provides a dual-band antenna integrated with GSM wireless communication apparatuses that have a broad effective operating band to significantly enhance the transceiving performance. Therefore, the present invention is novel, useful and non-obvious.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A dual-band antenna, which is integrated with GSM wireless communication apparatuses, comprising:

a first radiation unit, being a U-shaped three-dimensional structure, having a first extension portion at one terminal and a second extension portion on one side;

a first connecting portion, being disposed on the other side of the first radiation unit;

a second radiation unit, being a banded structure, connecting the first radiation unit with one side of the second radiation unit by the first connecting portion and a first gap formed between the first radiation unit and the second radiation unit, one terminal of the second radiation unit extending as a third extension portion, and the other side of the second radiation unit and one side of the third extension portion forming a fourth extension portion;

a second connecting portion, being disposed at the other terminal of the first radiation unit;

a grounding unit, being a banded structure, connected to the first radiation unit;

a grounding extension unit, being disposed on one side of the grounding unit, wherein a fourth gap is formed between the grounding extension unit and the second radiation unit by the second connecting portion, wherein a second gap is formed between the grounding unit and the second radiation unit and a third gap is formed between the grounding unit, the second connecting portion and the first radiation unit;

a signal feed-in terminal, being disposed on the second radiation unit; and a signal grounding terminal, being disposed on the grounding unit.

2. The dual-band antenna as recited in claim 1, wherein the first radiation unit, the first connecting portion, the second radiation unit, the second connecting portion, the grounding unit, the grounding extension unit, the signal feed-in terminal and the signal grounding terminal are formed as one metal structure.

3. The dual-band antenna as recited in claim 1, further comprising a support portion connected to the dual-band antenna to stabilize the dual-band antenna.

4. The dual-band antenna as recited in claim 1, further comprising a second grounding unit being disposed on the grounding unit so that the grounding unit is connected to a grounding device of the GSM wireless communication apparatus through the second grounding unit.

5. The dual-band antenna as recited in claim 1, wherein the operating frequency of the first radiation unit is lower than the operating frequency of the second radiation unit.

6. The dual-band antenna as recited in claim 1, wherein the operating frequency of the first radiation unit is 0.9 GHz to 1.1 GHz.

7. The dual-band antenna as recited in claim 1, wherein the operating frequency of the second radiation unit is 1.3 GHz to 2.1 GHz.

8. The dual-band antenna as recited in claim 1, wherein the first radiation unit and the second radiation unit are disposed in parallel or approximately in parallel.

9. The dual-band antenna as recited in claim 1, wherein the second radiation unit and the grounding unit are disposed in parallel or approximately in parallel.

10. The dual-band antenna as recited in claim 1, wherein a fifth gap is formed between the grounding extension unit and the fourth extension portion.

11. The dual-band antenna as recited in claim 1, wherein a sixth gap is formed between the second gap and the fourth gap.

12. The dual-band antenna as recited in claim 1, wherein a seventh gap is formed between the second gap and the third gap.

* * * * *